US010253498B2

(12) United States Patent
Stevens et al.

(10) Patent No.: US 10,253,498 B2
(45) Date of Patent: Apr. 9, 2019

(54) BUILDING COMPONENT

(71) Applicant: STUDCO AUSTRALIA PTY LTD, Croydon South (AU)

(72) Inventors: Ben Stevens, Croydon South (AU); Gordon Stevens, Croydon South (AU); Simon McKechnie, Croydon South (AU); Warwick McAlpin, Croydon South (AU); Peter Stevens, Croydon South (AU)

(73) Assignee: Studco Australia PTY LTD., Victoria (AU)

( * ) Notice: Subject to any disclaimer, the term of this patent is extended or adjusted under 35 U.S.C. 154(b) by 0 days.

(21) Appl. No.: 15/440,153

(22) Filed: Feb. 23, 2017

(65) Prior Publication Data

US 2017/0241137 A1 Aug. 24, 2017

(30) Foreign Application Priority Data

Feb. 24, 2016 (AU) ..... 2016900660
Jul. 12, 2016 (AU) ..... 2016902732

(51) Int. Cl.

| | |
|---|---|
| ***E04C 3/09*** | (2006.01) |
| ***E04B 2/60*** | (2006.01) |
| ***E04B 2/78*** | (2006.01) |
| *E04B 2/82* | (2006.01) |
| *E04B 9/18* | (2006.01) |

(52) U.S. Cl.

CPC ..... *E04C 3/09* (2013.01); *E04B 2/60* (2013.01); *E04B 2/789* (2013.01); *E04B 2/82* (2013.01); *E04B 9/18* (2013.01)

(58) Field of Classification Search

CPC ... E04C 3/09; E04B 2/789; E04B 2/60; E04B 9/18; E04B 2/82; E04B 2001/2463; E04B 1/98

USPC ..... 52/745.09, 745.12, 481.1, 855

See application file for complete search history.

(56) References Cited

U.S. PATENT DOCUMENTS 4,408,427 A * 10/1983 Zilch ..... E04F 13/0803 52/481.2
5,423,507 A * 6/1995 Florent ..... E04L 39/18 248/300

FOREIGN PATENT DOCUMENTS

EP 2868827 A1 * 5/2015 ..... E04C 3/005

* cited by examiner

*Primary Examiner* — Patrick J Maestri
(74) *Attorney, Agent, or Firm* — Woods Oviatt Gilman LLP; Katherine H. McGuire, Esq.

(57) ABSTRACT

A building component (1) for attachment to an uneven surface (32) such that a gap (34) exists at one or more locations between the building component (1) and the uneven surface (32), the building component (1) including mounting means (10) located at one or more positions along the building component (1), the mounting means (10) having a portion (20) adapted to be located outside the plane of the building component (1) and between the building component (1) and the uneven surface (32), wherein fastening means attaches the mounting means (10) to the uneven surface (32) to enable the building component (1) to remain substantially straight when attached to the uneven surface (32).

10 Claims, 10 Drawing Sheets

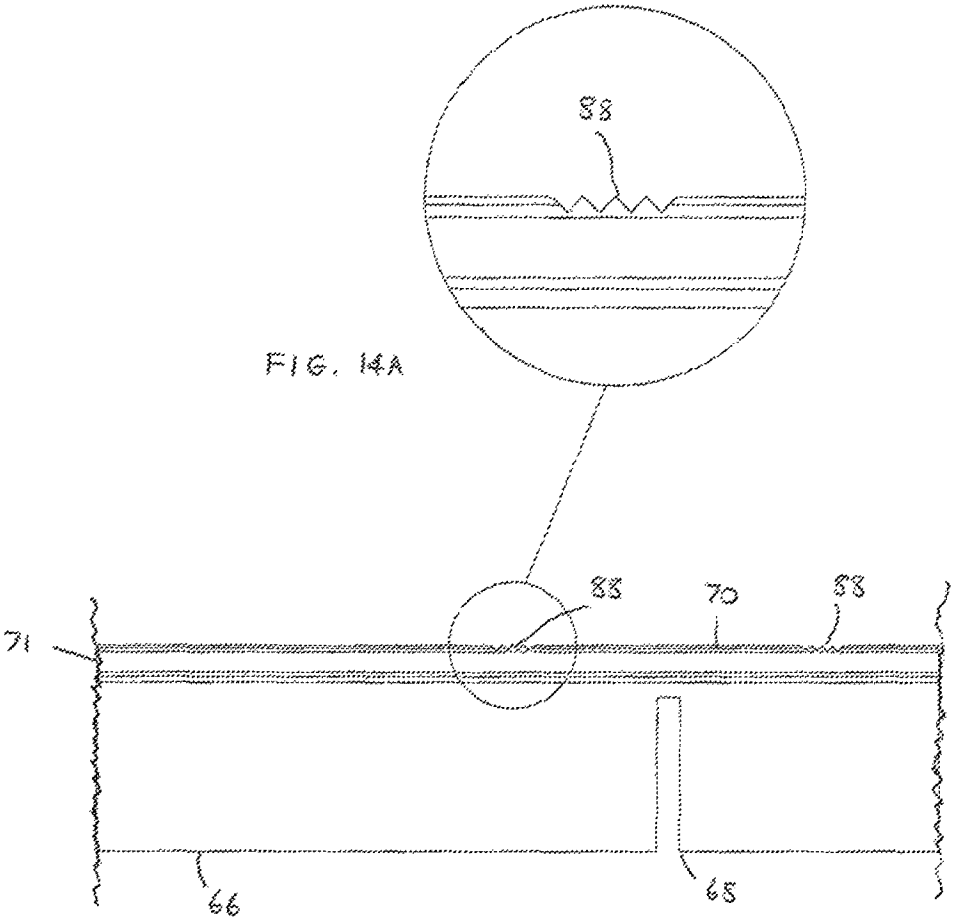
FIG. 14A
FIG. 14
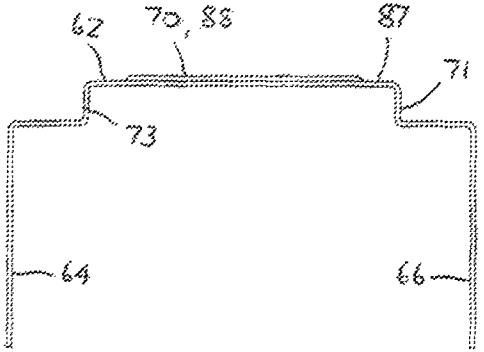
FIG. 13A

BUILDING COMPONENT

FIELD OF THE INVENTION

This invention relates to a building component and more particularly relates to a track for attachment to an uneven surface. A particular application of the invention is for a track to be attached to the underside of a concrete slab floor in a building. The track can form a top part of a stud wall with the attachment of the track to the surface resulting in an unstressed track.

BACKGROUND OF THE INVENTION

In multi-storey buildings, the formation of the floor of each successive storey involves pouring concrete into formwork with each floor generally extending out to the periphery of the building from a central core structure. Curtain walls are walls that extend between each concrete floor but do not bear any weight, as the curtain walls are suspended between the floors. These can include interior walls or exterior walls, with the exterior walls commonly being made from glass.

A common occurrence in a building above a certain height is when the building is subjected to high wind resulting in creaking, groaning or grating noises emanating from the connection of a curtain wall or stud wall to the underside of the slab floor. The underside of such a floor serves as the ceiling or roofing structure of the particular space where the stud wall or curtain walls exists. These noises are annoying and worrying to occupants of the building, particularly when the occupants are trying to rest, to the extent that some occupants are forced to vacate the building.

Previously the grating, groaning or creaking noises had been identified as originating from top head tracks, particularly deflection head tracks, associated with a curtain or stud wall. Part of the stud that connects to or is secured to the deflection head track rubs against the interior of the head track to create the noise. In order to overcome this, users had inserted strips of plastic to prevent the rubbing or grating of the stud against the head track. However a more fundamental cause of the noise has been identified as originating from the interface between the underside of the slab floor that forms the ceiling of a room, and the attachment of a head track to that underside. Generally, when concrete is poured into the formwork to form a concrete slab floor, it cures over time and, although the top surface of the slab is made smooth by building workers, the underside of the slab presents an uneven surface. When the head track is secured to the underside surface through a series of fasteners, the unevenness of the underside surface creates tension at various points along the C-channel shaped head track. This results in the legs or flanges of the track being splayed inwardly or outwardly depending on the gap between the surface of the slab and the web of the track. Thus the legs may be splayed inwardly when there is a relatively large gap between the track and surface, with fasteners securing the web to the surface at predefined distances. Furthermore where the surface of the slab pushes or compresses against the web of the track, then the legs can be splayed outwardly. When the studs are connected to the track, depending on whether the particular connection point is under tension or not under tension, it will produce noise under certain wind speeds that the building is subjected to. Thus, for example, a track that is under tension and the legs of the track splayed inwardly or outwardly, reacts to the wind load on the curtain wall, thus producing noise.

The present invention provides a track that, in a preferred form, is able to maintain a substantially straight profile so that connection of a stud at any location along the track will not produce any creaking or grinding noise due to contact between the stud and the track, in a high wind event.

SUMMARY OF THE INVENTION

According to a first aspect of the invention, there is provided a building component for attachment to an uneven surface such that a gap exists at one or more locations between the building component and the uneven surface, said building component including:

mounting means located at one or more positions along said building component, said mounting means having a portion adapted to be located outside the plane of the building component and between the building component and the uneven surface;

wherein fastening means attaches said mounting means to said uneven surface to enable said building component to remain substantially straight when attached to said uneven surface.

According to a second aspect of the invention, there is provided a method of attaching a building component to an uneven surface, wherein a gap exists at one or more locations between the building component and the uneven surface, said method including the steps of:

placing said building component against said uneven surface, securing the building component to the uneven surface using fastening means at mounting means located at one or more positions along said building component, said mounting means having a portion adapted to be located outside the plane of the building component and between the building component and the uneven surface;

such that said building component remains substantially straight when attached to said uneven surface.

Preferably, the building component is a substantially straight track generally channel-shaped in cross-section and having a first leg and a second leg and a web connecting said first leg to said second leg, said mounting means positioned in said web so that the web in use lies adjacent the uneven surface.

The first leg and/or said second leg may have slit means in the form of one or more slots for enabling adjustable attachment of a vertical member, such as a stud, to said building component. At least one of said one or more slots can be a kerf open at one end to enable the building component to be flexed or curved when attached to said surface. The web can have a raised portion defining a pair of shoulders to provide additional strength to said web. The raised portion may extend along the entire length of the web or exists at the location of said mounting means. The mounting means preferably includes a first elongate aperture or slit, a second elongate aperture or slit and a central portion between said first and second elongate apertures or slits. A series of attenuating grooves and ribs or corrugations may extend between respective ends of the first and second elongate apertures or slits.

Alternatively the mounting means is a deformable fixing tab that is hinged or otherwise connected to the track. The mounting means may be extendible to bridge said gap to engage with said uneven surface when fastened. The mounting means preferably has an aperture to allow said fastening means to extend therethrough to secure the mounting means and the building component to the uneven surface.

The building component may further include rebated rib means in a web of said building component, said rebated rib means located either along the entire length of the web or adjacent said mounting means.

According to a third aspect of the invention, there is provided a method of building construction to reduce noise from relative movement between abutting building components arising from building distortions, the abutting building components comprising a location component to be mounted to a building structure and a functional component to be mounted in position by cooperation with the locating component, the method including the steps of:

providing an elongated locating component having a plurality of mounting means located at positions along the length thereof, each said mounting means having a spacing portion arranged to be selectively located laterally outside the longitudinal line of the component, positioning the locating component in its generally desired position against a face of the building structure which is uneven or not straight along the line of the locating component, installing a fastening means at each of multiple ones of the mounting means so that at least one of the spacing portions is located outside the longitudinal line of the component so as to bridge a gap between the locating component and the face of the building structure whilst enabling the locating component to remain substantially straight, and subsequently mounting a functional component in its position cooperating with and abutting against the locating component.

In an embodiment, the locating component comprises an elongate straight building component according to the first aspect, and wherein the functional component comprises an elongated member extending generally orthogonally from the locating component.

The elongated member can be any one of a stud, a lintel, a batten, a top plate, a bottom plate, a joist or a bearer.

According to a fourth aspect of the invention, there is provided a method of attaching a building component to an uneven surface, wherein a gap exists at one or more locations between the building component and the uneven surface, said building component having a first leg, a second leg and a web joining said first leg to said second leg, said method including the steps of:

placing said building component against said uneven surface, providing slit means in either one or both of said legs such that an opening of the slit means extends through a distal or outer edge of said leg or legs;

securing the building component to the uneven surface using fastening means located at one or more positions along said building component;

such that said building component is able to substantially conform its shape to the contour of the uneven surface when attached to said uneven surface.

BRIEF DESCRIPTION OF THE DRAWINGS

Preferred embodiments of the present invention will hereinafter be described, by way of example, only with reference to the drawings in which:

FIG. 13A is an end view of the building component or track of FIG. 12;

FIG. 14 is a partial side view of the track of FIG. 13 showing a pair of corrugations associated with a mounting means;

FIG. 14*a* is an exploded or magnified view of one of the corrugations of the mounting means.

DETAILED DESCRIPTION OF THE PREFERRED EMBODIMENT

Figures 1, 2:
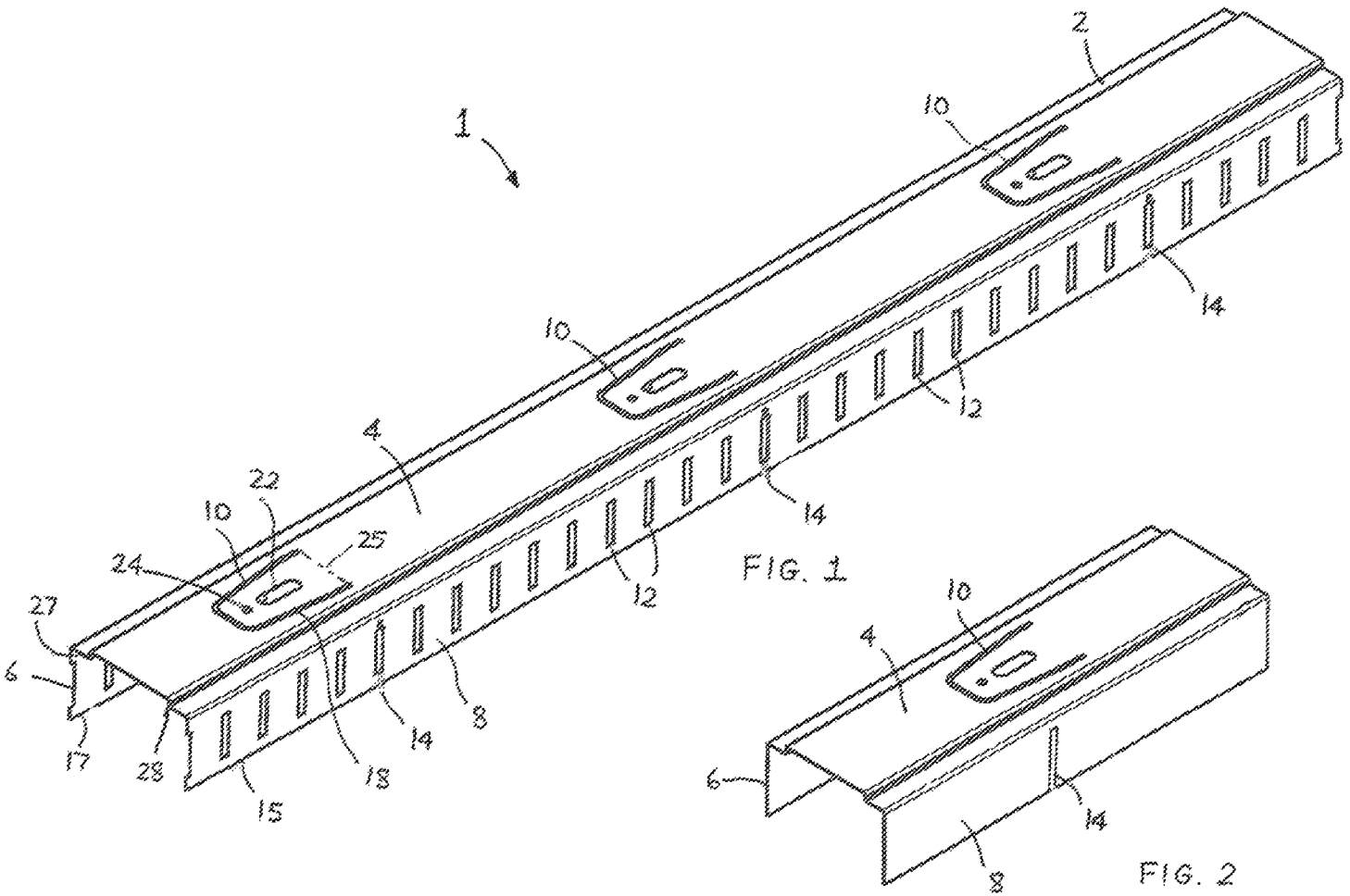
FIG. 1 is a perspective view from above of a building component, in the form of a horizontal member being a track, for attachment to an uneven surface, the track having one or more mounting means located therein.
FIG. 2 is a perspective view of a part of a track similar to FIG. 1 except having one aperture located at various distances along one of the legs of the track.
Figure 3:
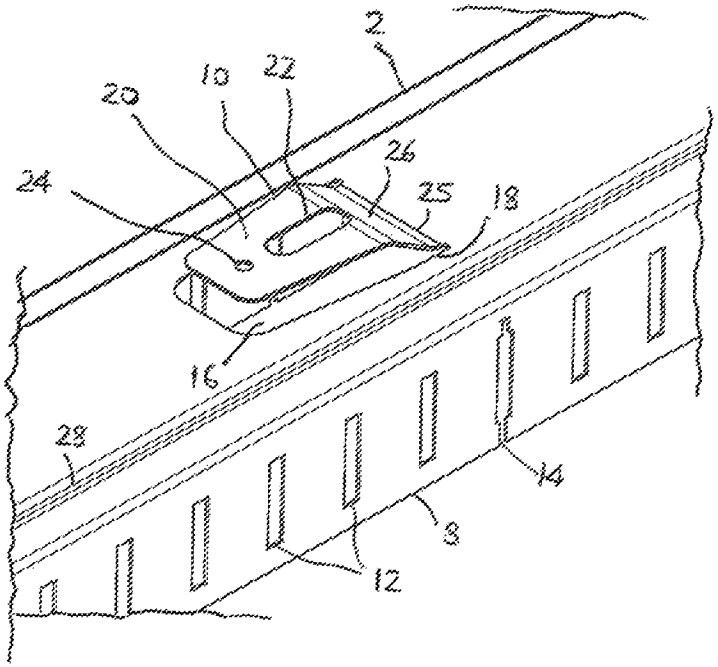
FIG. 3 is an exploded perspective view of a mounting means formed at various distances along the web of the track of FIG. 1 shown with a mounting means ready to be used in a position where a gap exists between an underneath uneven surface of a slab and the top of the surface of the web of the track.
Figure 6:
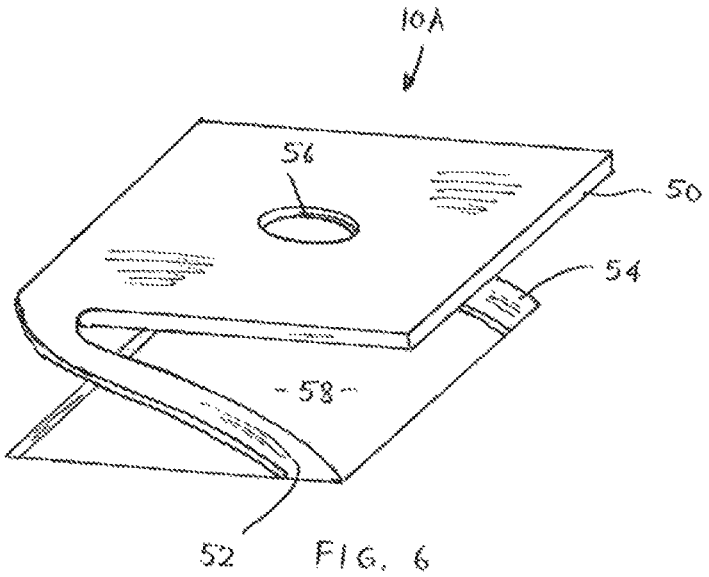
FIG. 6 is a perspective view of an alternative mounting means to that disclosed in FIGS. 1 to 3.
Figure 7:
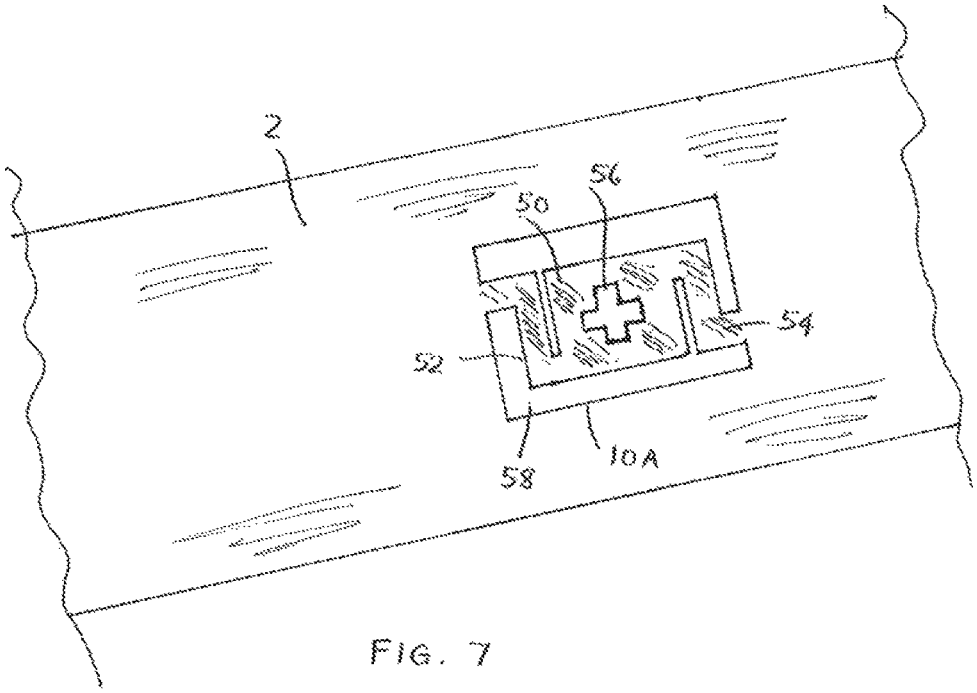
FIG. 7 is a plan view of the building component with a modified mounting means of FIG. 6.

Referring to FIG. 1 there is shown a building component 1, in the form of a substantially straight horizontal member such as a track 2 having first leg 6 and second leg 8 and web 4 connecting the first and second legs 6, 8. Located at various intervals along the web 4 is a series of mounting means in the form of deformable fixing tabs 10. Each fixing tab 10 is constructed so that a user can easily push the a portion of the tab upwardly and outwardly of the plane of the building component, and specifically outwardly of the plane of web 4 (and/or a raised portion of the web 4), to a position as shown in FIG. 3, where section 20 of tab 10 is raised so instead it protrudes outwardly from aperture 16, in which the undeformed tab 10 resided. Each of the tabs 10 can be formed by pressing a desired shape into sheet metal to create a score or cut out 18 so that it is hinged to the web 4 at a hinge section 25. Alternative arrangements for the tab 10 are available, for example as shown in FIGS. 6 and 7, where an aperture 58 is created in the web 4 and a tab 10A is connected to the sides of the aperture 58 by two legs 52, 54 (at a rear side to the tab 10A) so that a user can push out, manually or using a tool to fasten a fastener that protrudes through aperture 56, the flexible tab portion 50 so that the legs 52, 54 of the tab 10A extend out of the plane of the surface of the web 4. In either arrangement there is presented a surface that is outward from the plane of the web 4 to enable a securing/fastening means to secure that portion of the track 2 to an uneven surface of a structure, such as the underneath surface of a concrete slab, to be described in relation to FIG. 5.

Each leg 6 and 8 has a series of slots 12 formed at regular intervals to enable the variable connection of the top of a vertical member such as a stud inside the track 2 such that the top of the stud is abutting against the inside surface of web 4 and/or interior side of each of the legs 6, 8 of track 2. Each slot 12 is elongate which enables fine adjustment of the connection of the stud to the track 2. Located at a greater separation is a slit means, in the form of a kerf 14, which has an opening to the lower or bottom edge 15 and 17 of the legs 8 and 6 respectively. As shown in FIG. 2, the adapted kerfs 14 may be the only type of slot in legs 6 and 8 rather than a combination of the slots 12 and kerfs 14, as seen in FIG. 1. The purpose of enabling the kerf 14 to be open to the bottom edge 15, 17 of a respective leg 8, 6 is so that if the track 2 is shaped to have a curved connection to a surface, for example an arch, then the opening of the kerf 14 enables flexibility of the sections of each leg 6, 8 between adjacent kerfs 14. In other words the legs 6 and 8 have room to enable the sections of the legs 6, 8 between adjacent kerfs 14 to bend accordingly. The one or more open kerfs 14 also allow flexibility in a track 4 to follow the variations in depth, or undulations, of the uneven surface so that the track can be secured through to the uneven surface fasteners to minimise or eliminate any gaps between the web of track 4 and the uneven surface, such as 32 in FIG. 5.

Referring further to FIG. 3, a location hole 24 exists in the section 20 of tab 10. Hole 24 enables a user to temporarily affix the track 2 to the uneven surface at various locations before permanently securing each tab 10 by a fastener 38 (see FIG. 5) which protrudes through aperture 22 in tab 10. Aperture 22 is of a predefined length to enable positioning of the fastener 38 at a suitable location along the exposed underneath surface 32 of the slab 30. A ramp section 26 of the tab 10 is hinged to web 4 through hinge section 25. The mount 10 is flexible enough to enable variability in extension depending on the gap between the surface 32 and the top or exterior surface of the web 4.

Figure 4:
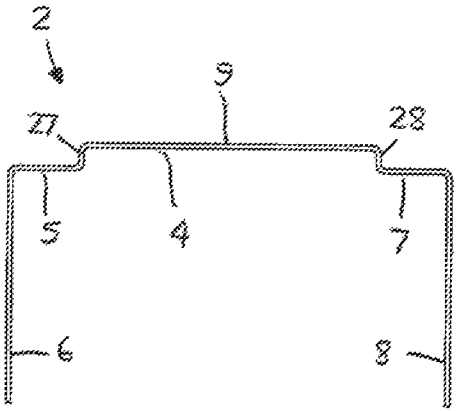
FIG. 4 is an end view of the track of FIG. 1.

Referring to FIG. 4, web 4 has a protruding section 9 formed by separate rebated rib sections 27 and 28 that extends along the whole length of web 4. However, in certain situations multiple sections 9 can be positioned where the track 2 needs additional strength, for example, in and around the locations of each of the tabs 10. The rebated ribs 27 and 28 accordingly form separate shoulder sections 5 and 7 in the profile of web 4 shown in FIG. 4. The raised section 9 provides additional strength so that it is harder to bend the track 2 and therefore enables the track 2 to remain relatively substantially straight.

Figure 5:
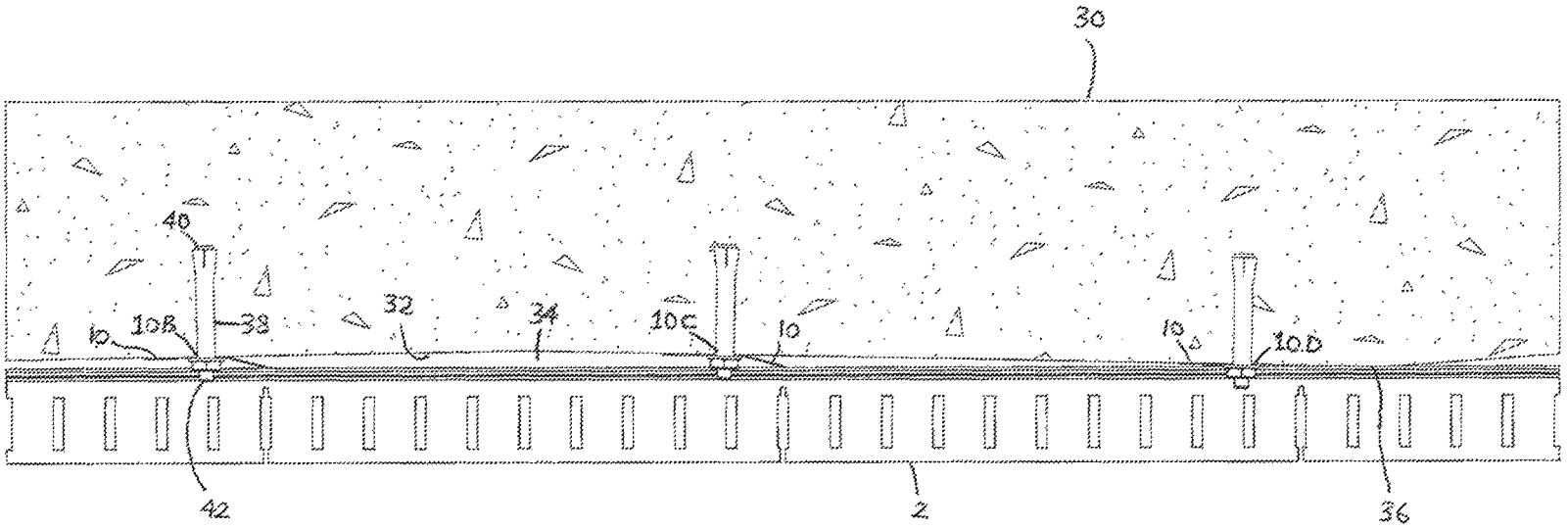
FIG. 5 is a side view of the track of FIG. 1 connected to an underneath uneven surface of a concrete slab where the underneath surface of the slab presents an uneven surface.

Referring to FIG. 5 there is shown the connection of track 2 to an underside surface 32 of concrete slab or floor 30. Three connection points are shown with the rightmost connection showing the tab 10D as having no extension given that the corresponding connection is relatively flush with the web 4 of track 2. The other two connection points show an outward extension of the respective tabs 10B and 10C where bolts 38 have been secured in a corresponding aperture 40 and nut 42 secures the tabs 10B and 10C to the underneath surface 32. These are both at a position where the underside surface 32 presents a gap 34 between the track 2 and the surface 32. The result is that the track 2 remains substantially straight and the tabs 10 are raised to the required degree, or not raised, to keep the track 2 substantially straight, even though the underneath surface 32 is uneven.

Figures 8, 9:
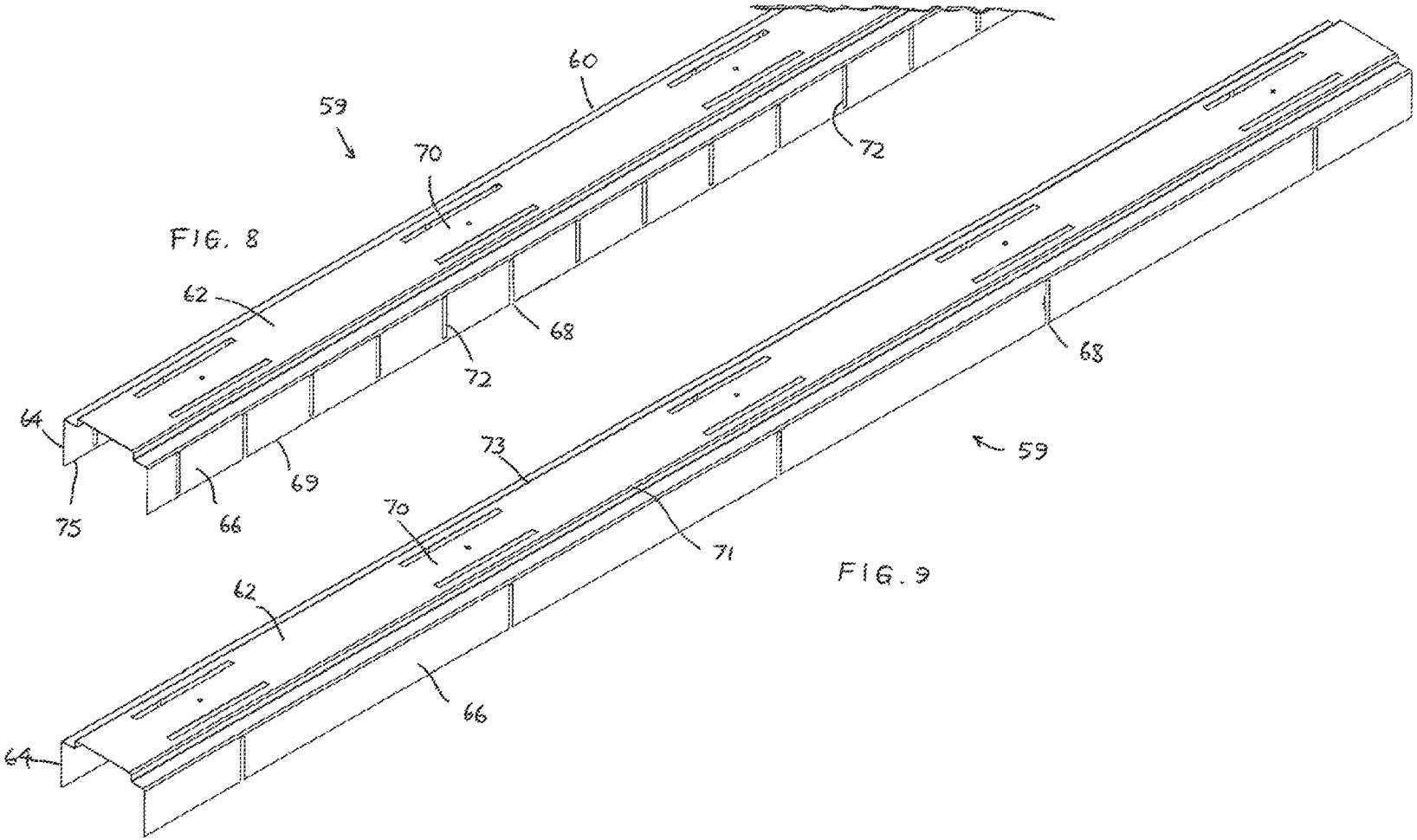
FIGS. 8 and 9 are perspective views from above of a building component according to a further embodiment, the building component being in the form of a horizontal member such as a track, for attachment to an uneven surface, with the track having one or more alternate mounting means located therein.
Figure 9A:
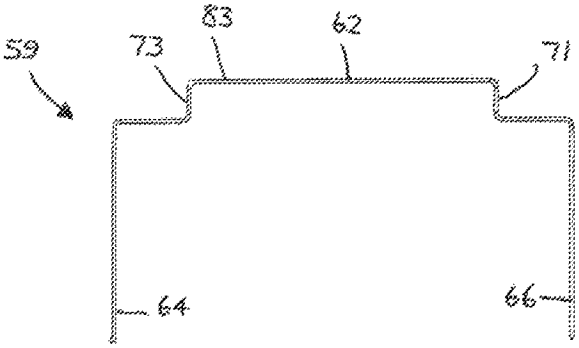
FIG. 9A is an end view of the building component or track of FIG. 8.

Referring to FIGS. 8, 9 and 9A there is shown an alternative construction of a building component 59, in the form of a straight horizontal member such as a track 60 which has first leg 64 and second leg 66 with web 62 connecting the first and second legs 64 and 66. Located at various intervals along the web 62 are a series of mounting means 70 in the form of deformable fixing tabs. One or both of the legs 64 and 66 may have a series of open slit means or kerfs 68, which extend fully to a lower edge 69 or 75 of the respective leg 66 and 64 or have slots 72 that are contained fully within the leg 66 or 64. In FIG. 9 there is shown a series of such kerfs 68 but are less in number when compared to the number of slots 72 in either or both of the legs 64, 66 shown in FIG. 8. FIG. 9A shows web 62 has a protruding section 83 formed by separate rebated rib sections 71 and 73 that extends along the whole length of web 62.

Figure 10:
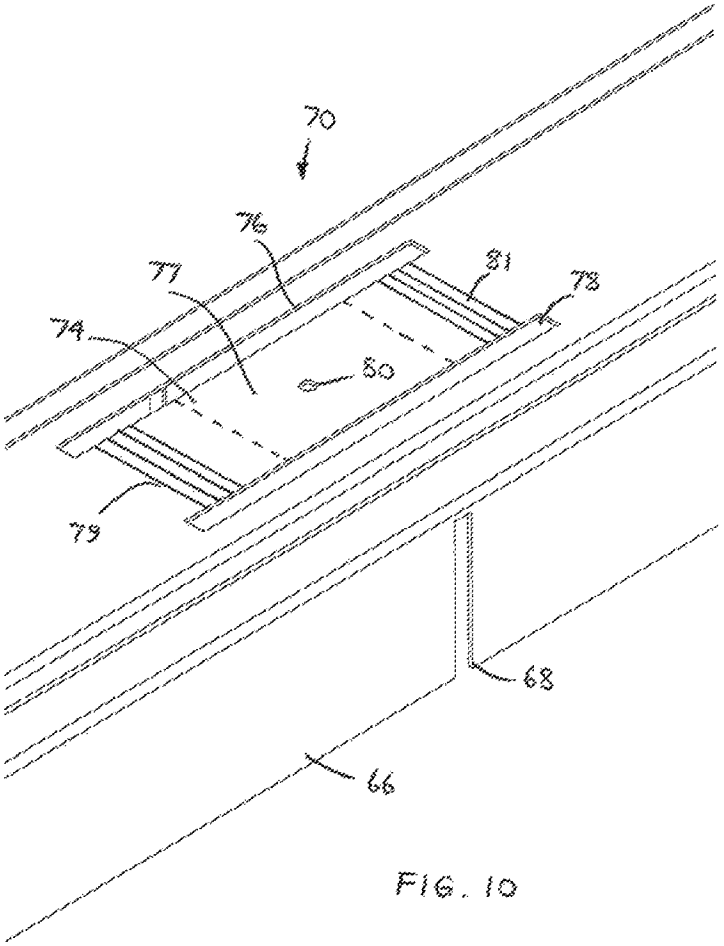
FIG. 10 is an exploded perspective view of the alternative mounting means of FIGS. 8 and 9.

Referring to FIG. 10 there is shown in more detail the alternative mounting means 70 which includes a first aperture or slit 76 and a second aperture or slit 78, each of the apertures 76 and 78 being bridged or joined by a central portion 74. Each of the apertures 76, 78 are elongate and there is a location hole 80 used to locate a fastener device, such as a nail, by a user in order to attach the track 60 to an uneven surface at one or more mounting points located along the length of the web 62 of the track 60.

Figure 11:
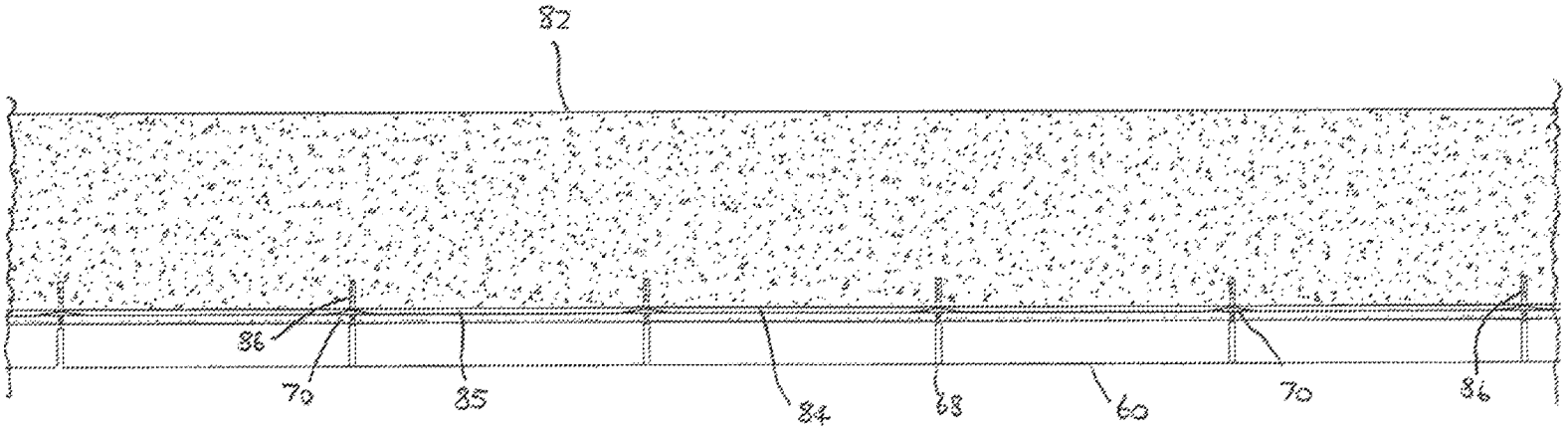
FIG. 11 is a side view of the building component of FIG. 9 connected to an underneath surface of a concrete slab where the underneath surface of the slab presents an uneven surface.

In use, a user would, either manually or with a tool, press upwardly (refer to FIG. 10) against an underneath surface of the web 4 in the vicinity of the portion 77 around the location hole 80. This raises the portion 77 above the plane of the remainder of the web 62 and can be extended to cover any gap that exists between the uneven surface and the web 62. The sections 79 and 81 of central portion 74 generally taper downwardly from the raised portion 77 to the plane of the web 62 surrounding the mounting portion 70. The provision of the apertures 76 and 78 enable the central portion 74 to flex upwardly and maintain its position there. In reference to FIG. 11 the user can place the track 60 against the uneven surface 84 of the concrete layer or floor 82 and use a series of securing means 86, such as nails or screws, through each locating hole 80 at each mounting means 70. Pressure applied by the tool, or by hand, flexes the central portion 77 outwardly whereby the fastener or securing means 86 can then be secured to the layer 82 and thereby secure the track 60 to the underside surface 84. FIG. 11 shows the outward or upward flexing of the central portion 77 of each of the mounting means 70 which goes across a gap 85 between the surface 84 and the web 62 while maintaining the track in a substantially straight or horizontal profile.

Figures 12, 13:
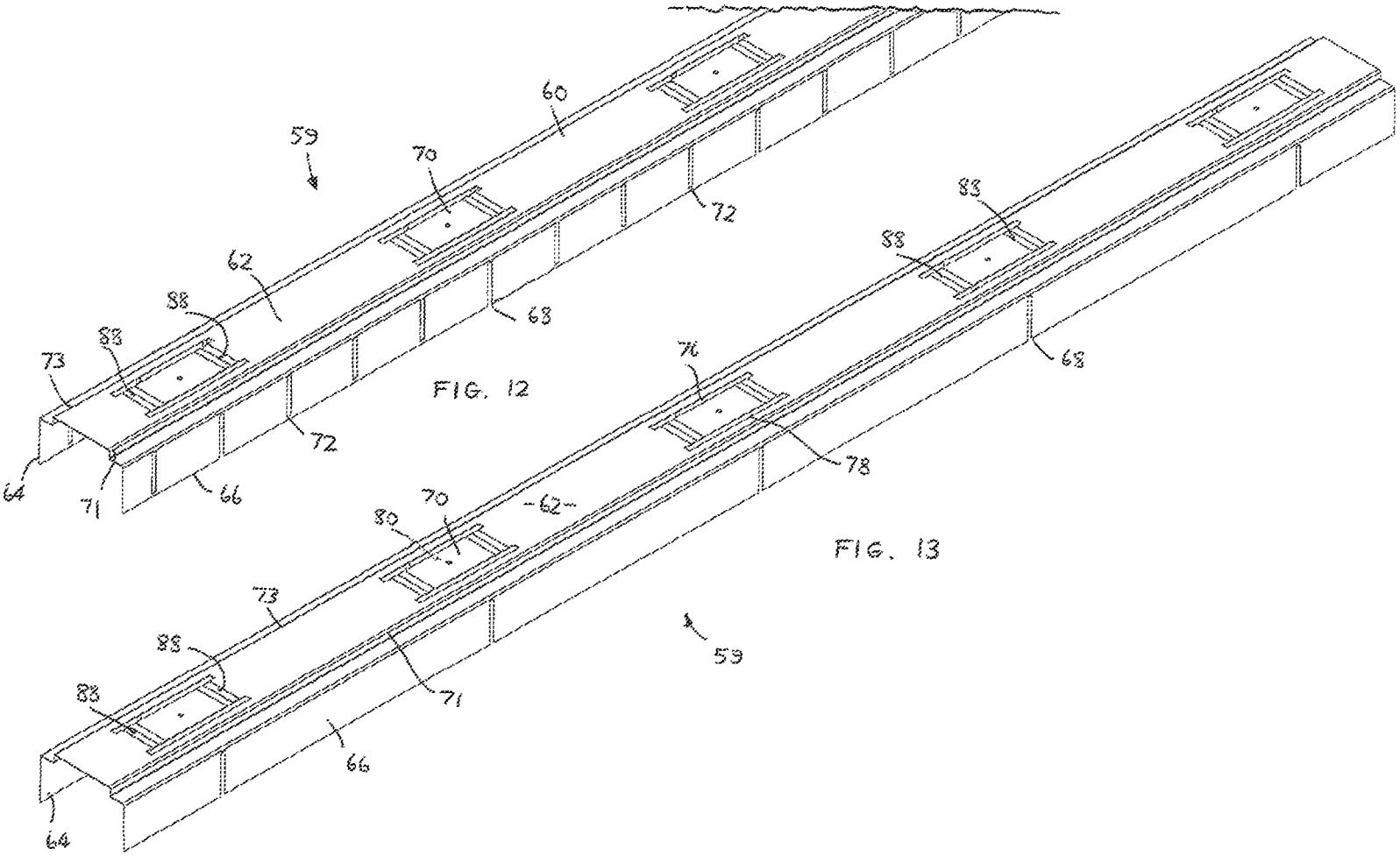
FIG. 12 is a perspective view from above of yet a further embodiment of a building component in the form of a horizontal member in the form of a track and having a mounting means with a series of ribs or corrugations.
FIG. 13 is a view similar to FIG. 12 of a building component that has less slots in each of the legs of the track.
Figure 15:
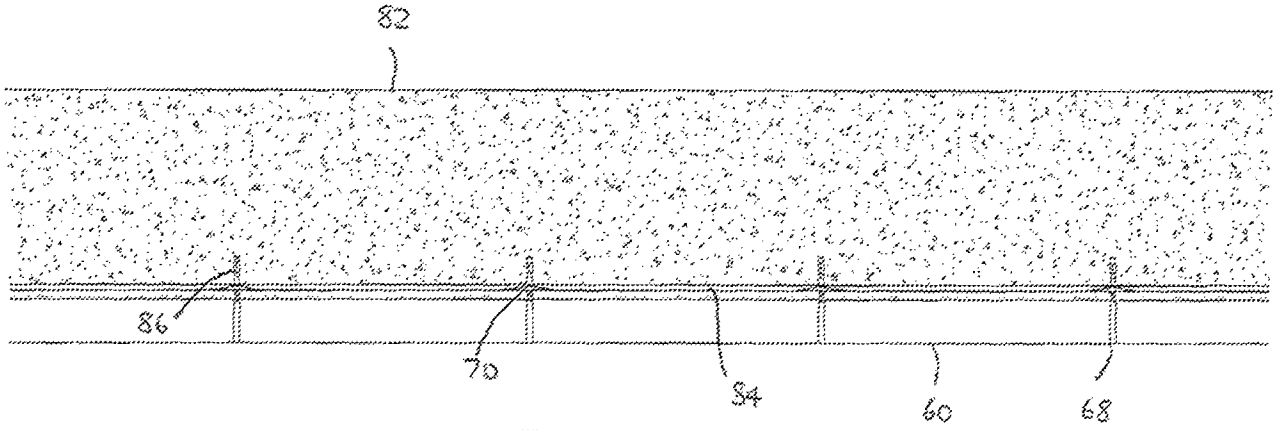
FIG. 15 is a side view of the track of FIG. 1 which is similar to FIG. 11.

Referring to FIGS. 12, 13 and 13A there is shown a modified version of the building component 59 including track 60 in which a series of ribs/grooves or corrugations 88 is provided on the outer longitudinal extremities of the central portion 74 of each mounting means 70. This is shown in further detail in FIGS. 14 and 14*a* where the ribs or corrugations 88 are located generally in the regions 79 and 81 (see FIG. 10) between respective or corresponding ends of the apertures 76 and 78. The provision of these ribs or corrugations 88 makes the central section 74 more flexible and easier to push outwardly out of the plane of the remainder of the web 62. The ribs/corrugations 88 act like an accordion or have a concertina effect, so that in profile when the tab 70 is pushed outwardly, the ribs/corrugations 88 appear in a step-wise manner. FIG. 13A shows web 62 has a protruding section 87 formed by the separate rebated rib sections 71 and 73, and having an end view outline of a mounting means 70 with corrugations 88, that extends along the whole length of web 62.

In a particularly preferred embodiment, in situations where there is substantial distortion or unevenness in surface 32, the combination of (a) the provision of the kerfs 14, 68 to enable bending of either leg 6, 8, (b) the provision of the rebated ribs 27, 28 and (c) the provision of the concertina-like effect of the corrugations 88 (or alternating ribs and grooves) in the tab 10 when pushed out of the plane of web 4 or 62, enables the track 2, 60 to connect to the surface 32 and to keep the legs 6, 8 and the track 2, in general, substantially straight in side and end profiles. The concertina-effect of the corrugations 88 provides much tension on the track 2, 60 compared with prior art arrangements.

In use, the user positions the track 2 and can temporarily keep the track 2 in that position by using screws or other fasteners through the location holes 24 at each tab 10. The user then pushes or secures one or more fasteners through the aperture 22 of each tab 10 into a pre-drilled hole in the slab 30. The tab 10 can extend or flex outwardly to abut the surface 32. At points such as 36 the tab 10 may not need to flex outwardly. In this case there may be other apertures along the length of the web 4 that do not necessarily use the tab 10 at which fasteners can secure the track to the underside surface 32. Once the track 2 has been secured at the required points, it presents an unstressed track which is substantially straight and provides the opportunity for studs to be connected to the track at various locations. In a high wind event, there will be minimal or significantly reduced creaking or groaning noises emanating from the curtain wall as the top track, or any other track, will remain unstressed throughout its connection to the uneven surface.

The claims defining the invention are as follows:

1. A method of attaching a building component to an uneven surface, wherein a gap exists at one or more locations between the building component and the uneven surface, said method including the steps of:

placing said building component against said uneven surface, securing the building component to the uneven surface using fastening means at a mounting element located at one or more positions along said building component, said mounting element having a portion adapted to be located outside a plane of the building component and between the building component and the uneven surface;

such that said building component remains substantially straight when attached to said uneven surface.

2. A method of building construction to reduce noise from relative movement between abutting building components arising from building distortions, the abutting building components comprising a location component to be mounted to a building structure and a functional component to be mounted in position by cooperation with the locating component, the method including the steps of:

providing an elongated locating component having a plurality of mounting means located at positions along the length thereof, each said mounting means having a spacing portion arranged to be selectively located laterally outside the longitudinal line of the component, positioning the locating component in its generally desired position against a face of the building structure which is uneven or not straight along a line of the locating component, installing a fastening means at each of multiple ones of the mounting means so that at least one of the spacing portions is located outside a longitudinal line of the component so as to bridge a gap between the locating component and the face of the building structure whilst enabling the locating component to remain substantially straight, and subsequently mounting a functional component in its position cooperating with and abutting against the locating component.

3. A method according to claim 1 wherein the building component comprises an elongate straight building component, said building component adapted to be attached to an uneven surface such that a gap exists at one or more locations between the building component and the uneven surface, wherein fastening means attaches said mounting element to said uneven surface to enable said building component to remain substantially straight when attached to said uneven surface; and wherein the mounting element comprises an elongated member extending generally orthogonally from the building component.

4. A method according to claim 3 wherein the elongated member is any one of a stud, a lintel, a batten, a top plate, a bottom plate, a joist or a bearer.

5. A building component for attachment to an uneven surface where a gap is formed at one or more locations between the building component and the uneven surface, said building component comprising:

a) a substantially planar, elongated web portion;

b) a plurality of mounting elements located at one or more spaced positions along said web portion, each said mounting element including first and second spaced, parallel slits defining a central portion therebetween, said central portion having first and second tapered down portions at opposite ends of said central portion, said central portion and first and second tapered down portions adapted to be selectively deformed and movable from a first position substantially coplanar with said web portion to a second position located outside the plane of said web portion whereby said central portion, when in said second position, is configured to span the gap between the building component and the uneven surface, said central portion further including an aperture wherethrough a fastening element may be passed for fixedly fastening said central portion to the uneven surface.

6. A building component according to claim 5 wherein the building component is a substantially straight track generally channel-shaped in cross-section and having a first leg and a second leg said web portion connecting said first leg to said second leg, said mounting element positioned in said web portion so that the web portion in use lies adjacent the uneven surface.

7. A building component according to claim 6 wherein said first leg and/or said second leg has slit means in the form of one or more slots for enabling adjustable attachment of a vertical member to said building component.

8. A building component according to claim 7 wherein at least one of said one or more slots is a kerf open at one end to enable the building component to be flexed or curved when attached to said surface.

9. A building component according to claim 6 wherein said web portion has a raised portion defining a pair of shoulders to provide additional strength to said web portion.

10. A building component according to claim 9 wherein the raised portion extends along the entire length of the web or exists at the location of said mounting means.

* * * * *